US010516206B2

(12) United States Patent
Riisberg

(10) Patent No.: US 10,516,206 B2
(45) Date of Patent: Dec. 24, 2019

(54) ANTENNA STRUCTURE FOR A HEADSET

(71) Applicant: GN Audio A/S, Ballerup (DK)

(72) Inventor: Alexander Riisberg, Ballerup (DK)

(73) Assignee: GN AUDIO A/S (DK)

( * ) Notice: Subject to any disclaimer, the term of this patent is extended or adjusted under 35 U.S.C. 154(b) by 49 days.

(21) Appl. No.: 16/012,967

(22) Filed: Jun. 20, 2018

(65) Prior Publication Data

US 2019/0006741 A1 Jan. 3, 2019

(30) Foreign Application Priority Data

Jun. 30, 2017 (EP) ..... 17179068

(51) Int. Cl.

| | |
|---|---|
| ***H01Q 1/46*** | (2006.01) |
| ***H01Q 1/27*** | (2006.01) |
| ***H01Q 1/22*** | (2006.01) |
| ***H01Q 1/48*** | (2006.01) |

(52) U.S. Cl.

CPC ..... *H01Q 1/273* (2013.01); *H01Q 1/2291* (2013.01); *H01Q 1/46* (2013.01); *H01Q 1/48* (2013.01)

(58) Field of Classification Search

CPC .. H01Q 1/27; H01Q 1/22; H01Q 1/46; H01Q 1/48

USPC ..... 343/718

See application file for complete search history.

(56) References Cited

U.S. PATENT DOCUMENTS

| | | | | |
|---|---|---|---|---|
| 9,502,771 | B2 | 11/2016 | Harper et al. | |
| 2004/0021606 | A1 | 2/2004 | Shigihara | |
| 2008/0079645 | A1 | 4/2008 | Higasa et al. | |
| 2012/0013521 | A1* | 1/2012 | Saliga | H01Q 9/0407 343/860 |
| 2016/0205461 | A1* | 7/2016 | Fernandez-Medina | H04R 1/1091 381/74 |

FOREIGN PATENT DOCUMENTS

| | | |
|---|---|---|
| CN | 104659493 | 5/2015 |

OTHER PUBLICATIONS

Extended European Search Report for European patent application No. 17179068 dated Dec. 15, 2017.

* cited by examiner

*Primary Examiner* — Andrea Lindgren Baltzell
(74) *Attorney, Agent, or Firm* — Hamre, Schumann, Mueller & Larson, P.C.

(57) ABSTRACT

Disclosed is an antenna structure configured to be provided in a headset to be worn. The antenna structure has a radiator and ground plate. The radiator is arranged in a first plane, and the ground plate in a second plane. The first plane, in which the radiator is arranged, is configured to be arranged substantially parallel to the surface of the head of the user, when the user wears the headset in its intended position on the head. The radiator and the ground plate are connected by a first ground connector, a second ground connector and a feed connector. The radiator has an opening between the first ground connector and the second ground connector. The opening between the first ground connector and the second ground connector provides that an object is configured to be arranged between the first plane and the second plane.

18 Claims, 16 Drawing Sheets

| Name | Freq | Ang | Mag | RX |
|---|---|---|---|---|
| m1 | 2.4020 | -0.7033 | 0.1693 | 1.4075 - 0.0060i |
| m2 | 2.4410 | 53.5652 | 0.0789 | 1.0891 + 0.1391i |
| m3 | 2.4800 | 104.6367 | 0.1702 | 0.8709 + 0.2953i |

Closed, no opening, no object

| Name | Freq | Ang | Mag | RX |
|---|---|---|---|---|
| m1 | 2.4020 | -5.6450 | 0.1873 | 1.4568 - 0.0556i |
| m2 | 2.4410 | 39.7691 | 0.0843 | 1.1315 + 0.1229i |
| m3 | 2.4800 | 97.5447 | 0.1642 | 0.9093 + 0.3042i |

Opening, no object

| Name | Freq | Ang | Mag | RX |
|---|---|---|---|---|
| m1 | 2.4020 | -13.2298 | 0.2115 | 1.5091 - 0.1629i |
| m2 | 2.4410 | 8.4330 | 0.1056 | 1.2326 + 0.0386i |
| m3 | 2.4800 | 75.5099 | 0.1107 | 1.0323 + 0.2239i |

Opening with object

ANTENNA STRUCTURE FOR A HEADSET

PRIORITY DATA

This US patent application claims priority to European patent application no. 17179068.6 filed on Jun. 30, 2017, which is hereby incorporated by reference herein.

FIELD

The present disclosure relates to an antenna structure configured to be provided in a headset to be worn on or at the head of a user. The antenna structure comprises a radiator element in connection with a ground plate.

BACKGROUND

A typical patch antenna has a ground connector and a feed connector, where the feed connector is located close to the ground connector. The ground connector and the feed connector connect with respectively the ground plane and the radio frequency (RF) output in the printed circuit board (PCB) below the patch antenna. The patch antenna may be shaped as a ring.

SUMMARY

There is a need for an improved antenna structure.

Disclosed is an antenna structure configured to be provided in a headset to be worn on or at the head of a user. The antenna structure comprises a radiator element in connection with a ground plate. The radiator element is arranged in a first plane, and the ground plate is arranged in a second plane. The first plane, in which the radiator element is arranged, is configured to be arranged substantially parallel to the surface of the head of the user, when the user wears the headset in its intended position on the head. The radiator element and the ground plate are connected by a first ground connector, a second ground connector and a feed connector. The radiator element has an electrical length of about a half-wavelength between the first ground connector and the second ground connector. The radiator element has an opening between the first ground connector and the second ground connector. The opening between the first ground connector and the second ground connector provides that an object is configured to be arranged between the first plane and the second plane.

It is an advantage that the antenna structure provides that an object, for example a headset component, can be placed between the first plane and the second plane without substantially disturbing the radiation properties of the antenna structure. Thus the ground connection of the antenna structure, i.e. the ground connection between the radiator element and the ground plate by the first ground connector, the second ground connector and the feed connector, has relatively little impact on the radiation properties of the antenna structure.

It is an advantage that by providing the second ground connector, the sector or segment of the radiator element between the first ground connector and the second ground connector can be omitted thus providing the opening or gap, such that the ground loop is closed through the ground plate.

It is an advantage that the antenna structure has an isotropic, or smooth, or even, or steady radiation diagram or property in all or any directions which is desirable for a headset.

It is an advantage that the antenna structure has an electrical minimum (Emin) at the opening due to the arrangement of the first and second ground connectors. Thus an object can be arranged in or at the opening, where the electrical minimum is, without substantially effecting or disturbing the electrical properties of the antenna structure.

It is an advantage that the opening provides space for having for example a headset component extending through the opening. The headset component may be connected to the ground plate, i.e. an electrical connection, and extend through the opening.

Such a headset component could be a microphone boom electrically connected to the ground plate, e.g. connected to a printed circuit board (PCB) of the ground plate, and extending outwards through the opening. The headset component could be a charging connector, e.g. a USB charger.

The headset may be a headset of for example in-ear design. The headset may be a headset of supra aural design or circum aural design, where for example a microphone boom is provided in the headset, or where for example the headset comprises a charging port for receiving a charging connector.

The radiator element may act as an antenna or may comprise or exhibit antenna properties. The radiator element may be a patch antenna, a loop antenna or any other suitable radiator element of antenna element.

The ground plate may comprise a printed circuit board (PCB). The ground plate may in relation to antenna and antenna structure be known as a ground plane.

The radiator element and the ground plate are arranged in a first plane and in a second plane, respectively, thus the radiator element and the ground plate are arranged in different planes, i.e. there is a distance between the radiator element and the ground plate. The first plane and the second may be substantially parallel to each other.

The first plane, in which the radiator element is arranged, is configured to be arranged substantially parallel to the surface of the head of the user, when the user wears the headset in its intended position on the head. The surface of the head of the user may be the surface of an ear, the surface of the head behind the ear etc. As the headset is arranged at or on the ear of the user, when worn in its intended position of the head, the first plane may also be arranged substantially perpendicular to an ear-to-ear direction of the head of the user. In particular if the user wears a headset with an ear part for both ear, and both ear parts comprise an antenna, the ear-to-ear direction may be defined.

The radiator element and the ground plate are connected by a first ground connector, a second ground connector and a feed connector. In prior art, the radiator element, e.g. a patch antenna, is connected to the ground by one ground connector. Thus for the present antenna structure comprising the opening, two ground connectors are provided such that the ground loop is instead closed through the ground plate.

The radiator element has an electrical length of about a half-wavelength between the first ground connector and the second ground connector. The electrical length is the distance along the circumference/perimeter of the radiator element. The electrical length of the radiator element may correspond to a physical length of the radiator element. At e.g. DECT frequencies the wavelength $\lambda$ is about or approximately 60 mm, thus the half-wavelength $\lambda/2$ is about or approximately 80 mm.

The radiator element has an opening between the first ground connector and the second ground connector. The opening may be a gap, a space, a hole, a cut-out, etc. where a sector or segment of the radiator element is omitted. Thus the opening is where the radiator element is cut or where a sector, segment or part of the radiator element is omitted. Thus when viewing the radiator element from above, there may a longer distance between the first ground connector and the second ground connector along the circumference/perimeter of the radiator element which is the electrical length of the radiator element, and there may be a shorter distance between the first ground connector and the second ground connector which is the opening where a segment of the radiator element is omitted or cut out.

If for example a headset, e.g. a speaker housing of a headset, is small, the ground plate will also become small as it has to fit in the headset, e.g. in the speaker housing. The size of the ground plate determines the bandwidth of the operating frequency band of the antenna structure.

In headsets is it may be desirable that the operating frequency band of the antenna structure is the DECT frequency band operating at 1880 to 1900 MHz. Alternatively and/or additionally, the operating frequency band of the antenna structure may be the Bluetooth frequency band operating at 2.4 to 2.485 GHz.

In some embodiments the object is configured to be arranged at least partly between the first ground connector and the second ground connector. It is an advantage to place the object between, or at least partly between, or place at least part of the object between the first ground connector and the second ground connector because here is the electrical field minimum, and the object will have relatively little or no impact on the radiation properties of the antenna when arranged here.

In some embodiments the opening between the first ground connector and the second ground connector provides that the object is configured to extend through the opening. It is an advantage that due to the physical space in the opening there is space to arrange a headset component, e.g. microphone boom, to extend through the opening. The object may be connected to the PCB of the ground plate and extend through the opening.

In some embodiments the opening is less than ⅓ (one third) of the length of the radiator element, such as less than ¼, ⅕, ⅙, ⅐, or ⅛, or ⅑, or 1/10, or 1/15, or 1/20 of the length of the radiator element. If the radiator element has a two-dimensional shape which is circular, the opening may be less than 120 degrees, such as less than 110 degrees, such as less than 100 degrees, such as less than 90 degrees, such as less than 80 degrees, such as less than 70 degrees, such as less than 60 degrees, such as less than 50 degrees, such as less than 45 degrees, such as less than 40 degrees, such as less than 30 degrees, such as less than 20 degrees, such as less than 10 degrees, such as less than 5 degrees. The length of the radiator element decides the center frequency regardless of the size of the opening in the radiator element.

In some embodiments the radiator element has a two-dimensional geometric shape, such as circular or polygonal. The radiator element may have any two-dimensional shape, such as a regular structure, such as rectangular, triangular etc. A circular radiator element may be shaped like a ring, a disc etc. A polygonal radiator element may be formed by for example three or four segments, each segment having a length which is substantially equal to the lengths of the other segments, and the segments being arranged with an angle of about 90 is degrees relative to each other forming an approximately closed structure.

In some embodiments the first plane, in which the radiator element is arranged, is substantially parallel to the second plane, in which the ground plate is arranged.

In some embodiments the second plane is provided between the first plane and the surface of the head of the user, when the user wears the headset in its intended position on the head.

In some embodiments the radiator element has an inner perimeter/circumference and an outer perimeter/circumference, and wherein the distance between the inner perimeter/circumference and the outer perimeter/circumference defines the width of the radiator element along the length of the radiator element.

The perimeter of a polygon or the circumference of a circle is the linear distance around the edge. The radiator element may be a flat plate having a space or a hole, such as one or more holes. If the radiator element has for example one hole inside, the radiator element has an inner perimeter/circumference around the hole and an outer perimeter/circumference.

The distance between the inner perimeter/circumference and the outer perimeter/circumference defines the width of the radiator element, e.g. along the length of the radiator element. The width is e.g. 0.5 mm, 1 mm, 2 mm, 3 mm, 4 mm etc. The length of the radiator element is e.g. 70 mm, 80 mm, 90 mm, 100 mm, 110 mm, 120 mm, 130 mm, 140 mm etc.

The radiator element may have a plurality of holes, e.g. three holes arranged in a triangle, and it is understood that one or more holes inside the radiator element may not change the radiation properties of an antenna structure.

In some embodiments the width of the radiator element is constant along the length of the radiator element.

In some embodiments the width of the radiator element varies along the length of the radiator element. An electrical effect of a varying width of the radiator element is that the broad areas of the width will be acting as capacitive and the narrow areas of the width will be acting as inductive lumped elements. A mechanical effect of the varying width of the radiator element is that the narrow areas provide or allow space in the perpendicular direction to the ground plate for the object, e.g. headset components, e.g. mechanical buttons extending from the PCB on the ground plate to the side of the earphone housing facing towards the surrounding for allowing button on the headset which the user can manage e.g. for controlling volume of the audio in the headset.

In some embodiments the ground plate has a two-dimensional geometric shape similar to the two-dimensional geometric shape of the radiator element.

In some embodiments the ground plate has a perimeter/circumference.

In some embodiments the outer perimeter/circumference of the radiator element is larger than the perimeter/circumference of the ground plate. It is an advantage that the radiator element is as long as possible. Thus the outer perimeter/circumference of the radiator element is for example between 2% to 10% larger or longer than the perimeter/circumference of the ground plate, such as between 0.5 mm to 5 mm longer.

Alternatively, the outer perimeter/circumference of the radiator element may be smaller than the perimeter/circumference of the ground plate. Alternatively, the outer perimeter/circumference of the radiator element may be substantially the same as the perimeter/circumference of the ground plate. The size of the radiator element and ground plate may also be defined in terms of diameter or distance (in x direction), such that for example the diameter or distance (in x direction) of the radiator element is larger than the diameter/distance (in x direction) of the ground plate.

In some embodiments a space in the first plane is present within the inner circumference of the radiator element. Thus there may be a space within the radiator element, in the first plane, as there may be a hole in the radiator element. Thus due to this space the object may extend through the first plane.

In some embodiments the space in the first plane provides that the object is configured to extend through the space in the first plane. Thus the object may e.g. extend from between the first and second plane through the space in the first plane and then towards the side of the headset pointing towards the surroundings opposite pointing towards the ear. The space in the first plane may provide or allow space in the perpendicular direction to the ground plate for the object, e.g. headset components, e.g. mechanical buttons extending from the PCB on the ground plate to the side of the earphone housing facing towards the surrounding for allowing button on the headset which the user can manage e.g. for controlling volume of the audio in the headset.

There may be more than one object, thus a first object may extend through the opening between the first ground connector and the second ground connector. A second object may extend through the space of the first plane.

In some embodiments the object configured to be arranged between the first plane and the second plane is a headset component.

In some embodiments the object configured to be arranged between the first plane and the second plane is a charging connector, for example a USB charger.

In some embodiments the object configured to be arranged between the first plane and the second plane is one or more electrical wires configured for connecting a microphone boom arm of a headset to the ground plate.

In some embodiments the ground plate comprises a printed circuit board, the printed circuit board comprising a processing unit. The radiator element may feel more than just the PCB as the ground plate, e.g. everything behind the PCB may be seen by the antenna as the ground plate, e.g. also the battery, the speaker etc.

In some embodiments the operating frequency band of the antenna structure is the DECT frequency band operating at 1880 to 1900 MHz.

In some embodiments the operating frequency band of the antenna structure is the Bluetooth frequency band operating at 2.4 to 2.485 GHz.

In some embodiments the radiator element is arranged at a height above the ground plate. Thus there may be a distance between the radiator element and the ground plate, and accordingly a distance between the first plane and the second plane. The height between the radiator element and the ground plate defines the band width together with the ground plane. The height corresponds to the height or length of the two ground connectors and feed connector. The height may be the same or may vary along the entire inner and/or outer perimeter/circumference of the radiator element.

In some embodiments the height is in a range about 2 mm-10 mm, such as in a range about 3 mm-7 mm, such as in a range about 4 mm-5 mm.

Digital enhanced cordless telecommunication (DECT) is a standard primarily used for creating cordless phone systems. DECT may be used in home and small office systems, and is also available in many PBX systems for medium and large businesses. The DECT standard includes a standardized interoperability profile for simple telephone capabilities, called GAP, which most manufacturers implement. GAP-conformance enables DECT handsets and bases from different manufacturers to interoperate at the most basic level of functionality, that of making and receiving calls. The standard also contains several other interoperability profiles, for data and for radio local-loop services.

The DECT standard fully specifies a means for a portable unit, such as a cordless telephone, to access a fixed telecoms network via radio, but does not specify any internal aspects of the fixed network itself. Connectivity to the fixed network, that may be of many different kinds, is done through a base station or "Radio Fixed Part" to terminate the radio link, and a gateway to connect calls to the fixed network. In most cases the gateway connection is to the public switched telephone network or telephone jack, although connectivity with newer technologies such as Voice over IP has become available.

DECT operates in the 1880-1900 MHz band and defines ten channels from 1881.792 MHz to 1897.344 MHz with a band gap of 1728 kHz. Each base station frame provides 12 duplex speech channels, with each time slot occupying any channel. DECT operates in multicarrier/TDMA/TDD structure. DECT also provides Frequency-hopping spread spectrum over TDMA/TDD structure. If frequency-hopping is avoided, each base station can provide up to 120 channels in the DECT spectrum before frequency reuse. Each timeslot can be assigned to a different channel in order to exploit advantages of frequency hopping and to avoid interference from other users in asynchronous fashion.

Bluetooth (BT) is a wireless technology standard for exchanging data over short distances, using short-wavelength UHF radio waves in the ISM band from 2.4 to 2.485 GHz, from fixed and mobile devices, and building personal area networks (PANs). Bluetooth operates at frequencies between 2400 and 2483.5 MHz, including guard bands 2 MHz wide at the bottom end and 3.5 MHz wide at the top. This is in the globally unlicensed, but not unregulated, Industrial, Scientific and Medical (ISM) 2.4 GHz short-range radio frequency band. Bluetooth uses a radio technology called frequency-hopping spread spectrum. Bluetooth divides transmitted data into packets, and transmits each packet on one of 79 designated Bluetooth channels. Each channel has a bandwidth of 1 MHz. Bluetooth 4.0 uses 2 MHz spacing, which accommodates 40 channels. The first channel starts at 2402 MHz and continues up to 2480 MHz in 1 MHz steps. It usually performs 1600 hops per second, with Adaptive Frequency-Hopping (AFH) enabled.

Bluetooth Low Energy, also called Bluetooth LE, BTLE, BLE or Bluetooth Smart technology, operates in the same spectrum range, the 2.400 GHz-2.4835 GHz ISM band, as Classic Bluetooth technology, but uses a different set of channels. Instead of the Classic Bluetooth 79 1-MHz channels, Bluetooth Smart has 40 2-MHz channels. Within a channel, data is transmitted using Gaussian frequency shift modulation, similar to Classic Bluetooth's Basic Rate scheme. The bit rate is 1 Mbit/s, and the maximum transmit power is 10 mW.

The present invention relates to different aspects including the antenna structure described above and in the following, and corresponding system parts, methods, devices, systems, networks, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which:

FIGS. 6A, 6B, 6C schematically illustrate computer simulated radiation diagrams or patterns, seen in an inclined view from above, for:

FIG. 6A shows a prior art antenna structure having a closed circular loop radiator element.

FIG. 6B shows an antenna structure having an opening in the circular radiator element.

FIG. 6C shows an antenna structure having an opening in the circular radiator element and where an object is provided on the ground plate and extending out through the opening.

DETAILED DESCRIPTION

Figure 1A:
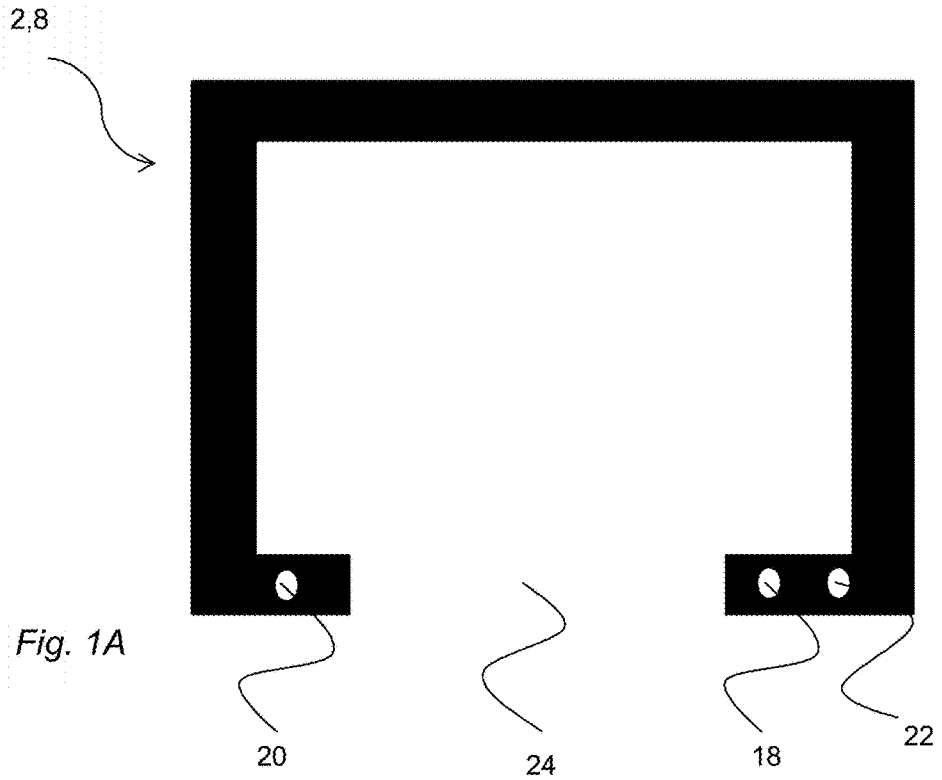
FIGS. 1A and 1B schematically illustrate an example of an antenna structure.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

Figure 1B:
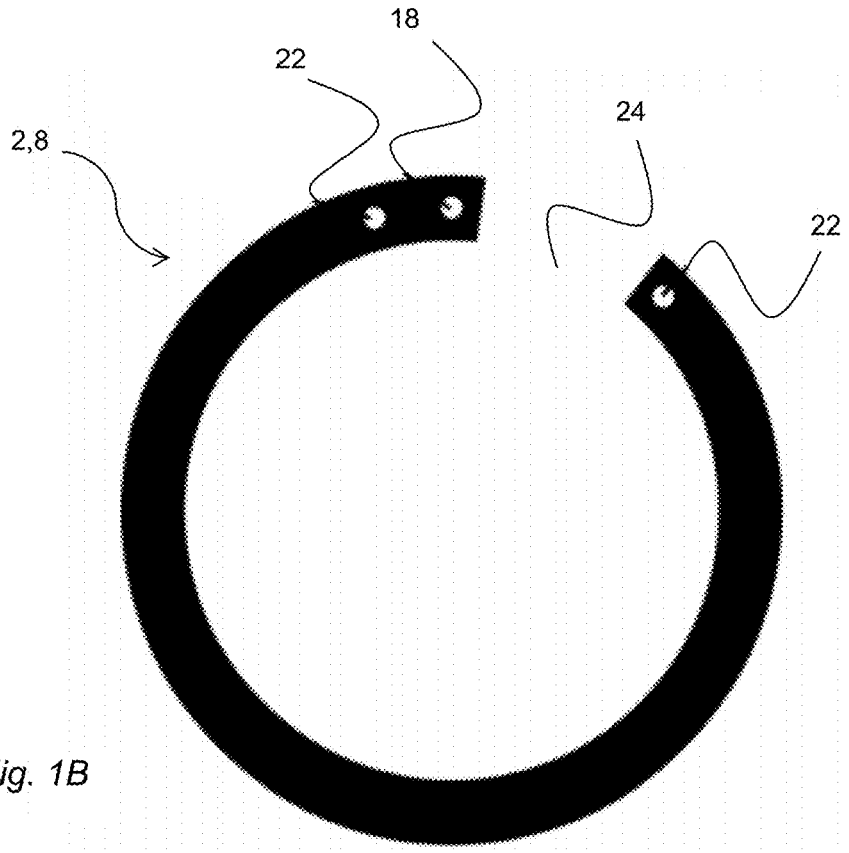

FIGS. 1A and 1B schematically illustrate an example of an antenna structure. The antenna structure 2 is configured to be provided in a headset (not shown) to be worn on or at the head of a user. The antenna structure 2 comprises a radiator element 8 in connection with a ground plate (not shown). The radiator element 8 and the ground plate are connected by a first ground connector 18, a second ground connector 20 and a feed connector 22. The radiator element 8 has an electrical length of about a half-wavelength between the first ground connector 18 and the second ground connector 20 along the radiator element. The radiator element 8 has an opening 24 between the first ground connector 18 and the second ground connector 20, where a segment of the radiator element 8 is omitted or cut out.

The radiator element 8 has an inner perimeter/circumference and an outer perimeter/circumference. The distance between the inner perimeter/circumference and the outer perimeter/circumference defines the width of the radiator element 8 along the length of the radiator element.

The width of the radiator element 8 is constant along the length of the radiator element in FIGS. 1A and 1B. However the width of the radiator element 8 may vary along the length of the radiator element 8.

FIG. 1A shows an example of a radiator element 2 which is polygonal, in this case rectangular having four sides.

FIG. 1B shows an example of a radiator element 2 which is circular.

Figure 2A:
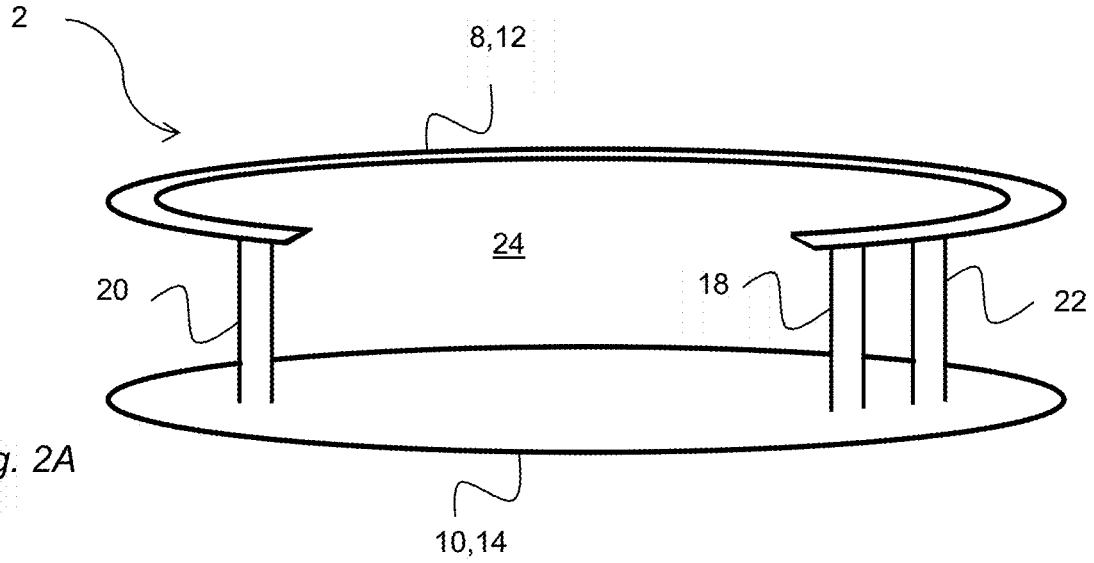
FIGS. 2A and 2B schematically illustrate an example of an antenna structure.
Figure 2B:
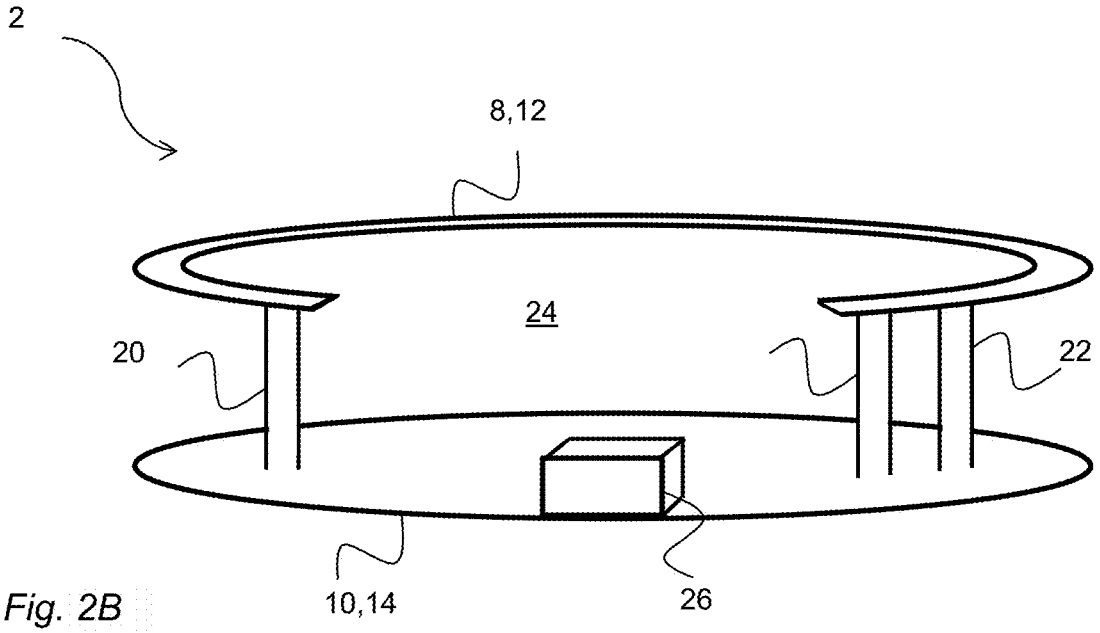

FIGS. 2A and 2B schematically illustrate an example of an antenna structure. The antenna structure 2 is configured to be provided in a headset to be worn on or at the head of a user. The antenna structure 2 comprises a radiator element 8 in connection with a ground plate 10. The radiator element 8 is arranged in a first plane 12. The ground plate 10 is arranged in a second plane 14. The first plane 12, in which the radiator element 8 is arranged, is configured to be arranged substantially parallel to the surface (not shown) of the head (not shown) of the user, when the user wears the headset 4 in its intended position on the head. The radiator element 8 and the ground plate 10 are connected by a first ground connector 18, a second ground connector 20 and a feed connector 22. The radiator element 8 has an electrical length of about a half-wavelength between the first ground connector 18 and the second ground connector 20 along the radiator element 8. The radiator element 8 has an opening 24 between the first ground connector 18 and the second ground connector 20.

The first plane 12, in which the radiator element 8 is arranged, is substantially parallel to the second plane 14, in which the ground plate 10 is arranged.

The ground plate 10 has a two-dimensional geometric shape similar to the two-dimensional geometric shape of the radiator element 8, which is circular in these figures. The ground plate 10 has a perimeter/circumference. The radiator element 8 has an inner perimeter/circumference and an outer perimeter/circumference.

The outer perimeter/circumference of the radiator element 8 is similar to the perimeter/circumference of the ground plate 10. However the outer perimeter/circumference of the radiator element 8 may be larger of smaller than the perimeter/circumference of the ground plate 10.

A space in the first plane 12 is present within the inner circumference of the radiator element 8. The space in the first plane 12 provides that an object, e.g. object 26 see FIG. 2B or another object is configured to extend through the space in the first plane 12.

The radiator element 8 is arranged at a height above the ground plate 10. The height may be in a range about 2 mm-10 mm, such as in a range about 3 mm-7 mm, such as in a range about 4 mm-5 mm. The height corresponds to the length of the first ground connector 18 or the second ground connector 20 or the feed connector 22.

FIG. 2B further shows that the opening 24 between the first ground connector 18 and the second ground connector 20 provides that an object 26 is configured to be arranged between the first plane 12 and the second plane 14.

The object 26 is configured to be arranged at least partly between the first ground connector 18 and the second ground connector 20.

The opening 24 between the first ground connector 18 and the second ground connector 20 provides that the object 26 is configured to extend through the opening 24.

Figure 3:
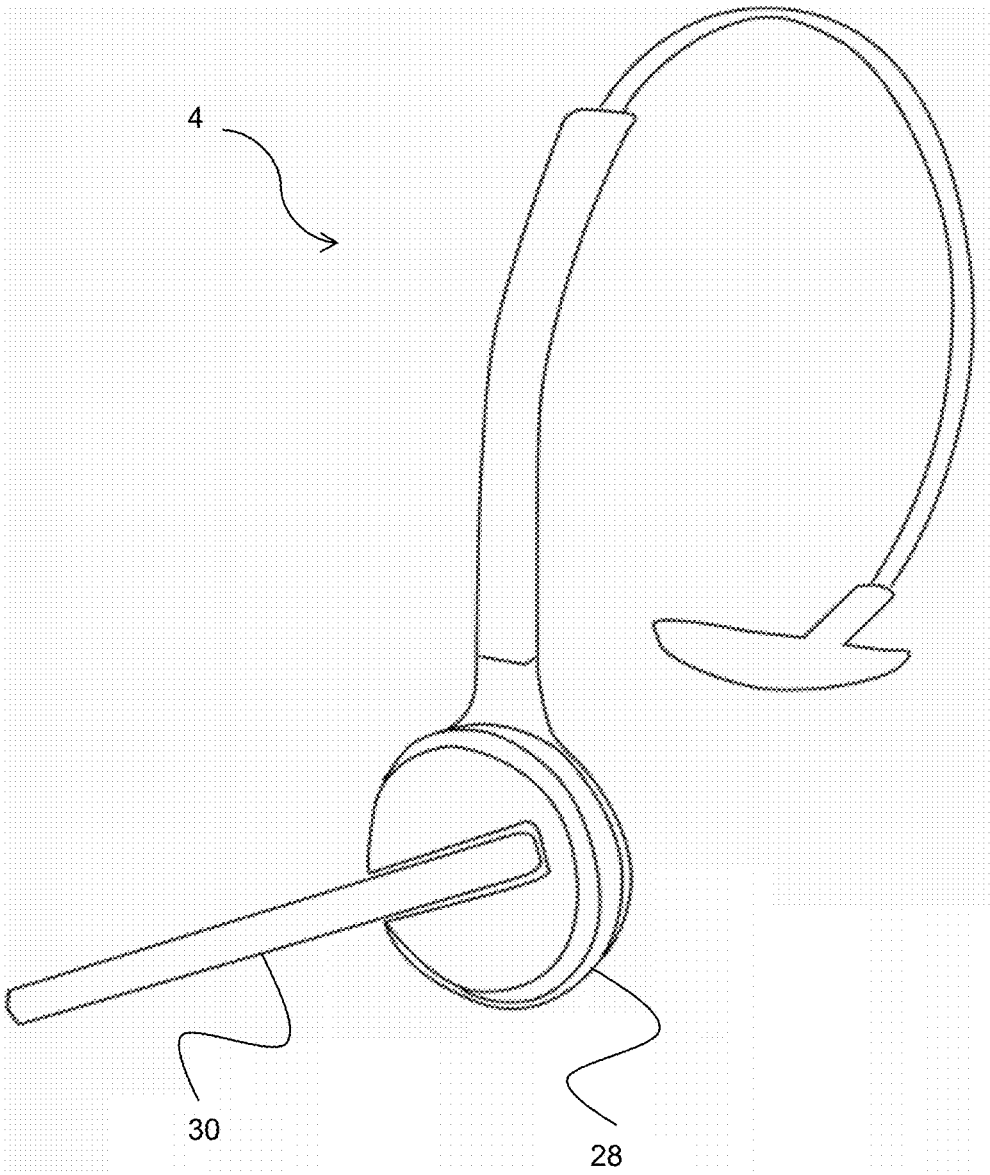
FIG. 3 schematically illustrates an example of a headset.

FIG. 3 schematically illustrates an example of a headset. An antenna structure (not shown) is configured to be provided in the headset 4 to be worn on or at the head (not shown) of a user. The antenna structure is configured to be arranged in the speaker housing 28 of the headset 4. The speaker housing may further comprise a speaker, a battery etc. The headset 4 comprises a microphone boom 30. Electrical wires from the microphone boom 30 may be the object which is configured to be arranged between the radiator element (not shown) in a first plane (not shown) and the ground plate (not shown) in a second plane (not shown) due to the opening (not shown) in the radiator element.

Figure 4:
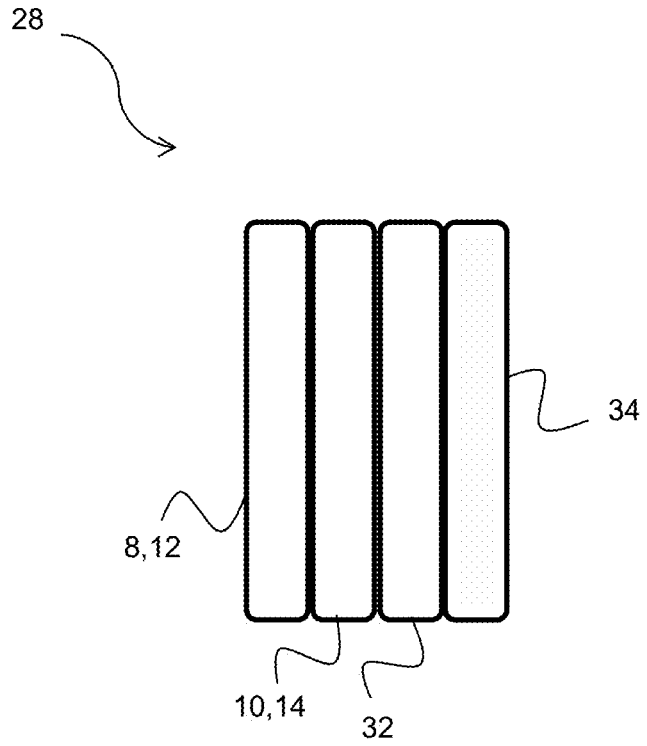
FIG. 4 schematically illustrates how headset elements can be arranged in a speaker housing of a headset.

FIG. 4 schematically illustrates how headset elements can be arranged in a speaker housing of a headset. In the speaker housing 28, the radiator element 8, in the first plane 10, is arranged proximate to the ground plate 10, in the second plane 14. On the opposite side of the ground plate 10, a battery 32 or other power source for the headset is arranged. On the opposite side of the battery 32, a speaker 34 or output transducer is arranged.

Figure 5:
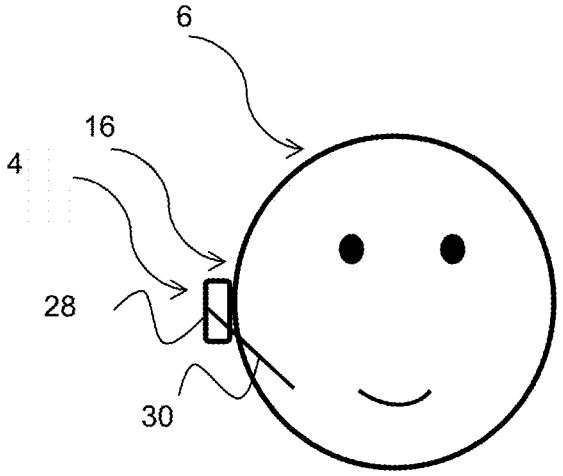
FIG. 5 schematically illustrates how the headset is arranged on the surface of the head of the user.

FIG. 5 schematically illustrates how the headset is arranged on the surface of the head of the user. The headset 4 is configured to be worn on or at the head 6 of a user. The headset 4 comprises a speaker housing 28 and a microphone boom 30. The first plane (see FIG. 4), in which the radiator element (see FIG. 4) is arranged, is configured to be arranged substantially parallel to the surface 16 of the head 6 of the user, when the user wears the headset 4 in its intended position on the head 6, such as on the ear.

Further it is seen from FIG. 4 and FIG. 5 that the first plane 12, in which the radiator element 8 is arranged, is substantially parallel to the second plane 14, in which the ground plate 10 is arranged. The second plane 14 is provided between the first plane 12 and the surface 16 of the head 6 of the user, when the user wears the headset 4 in its intended position on the head 6.

Figure 6A:
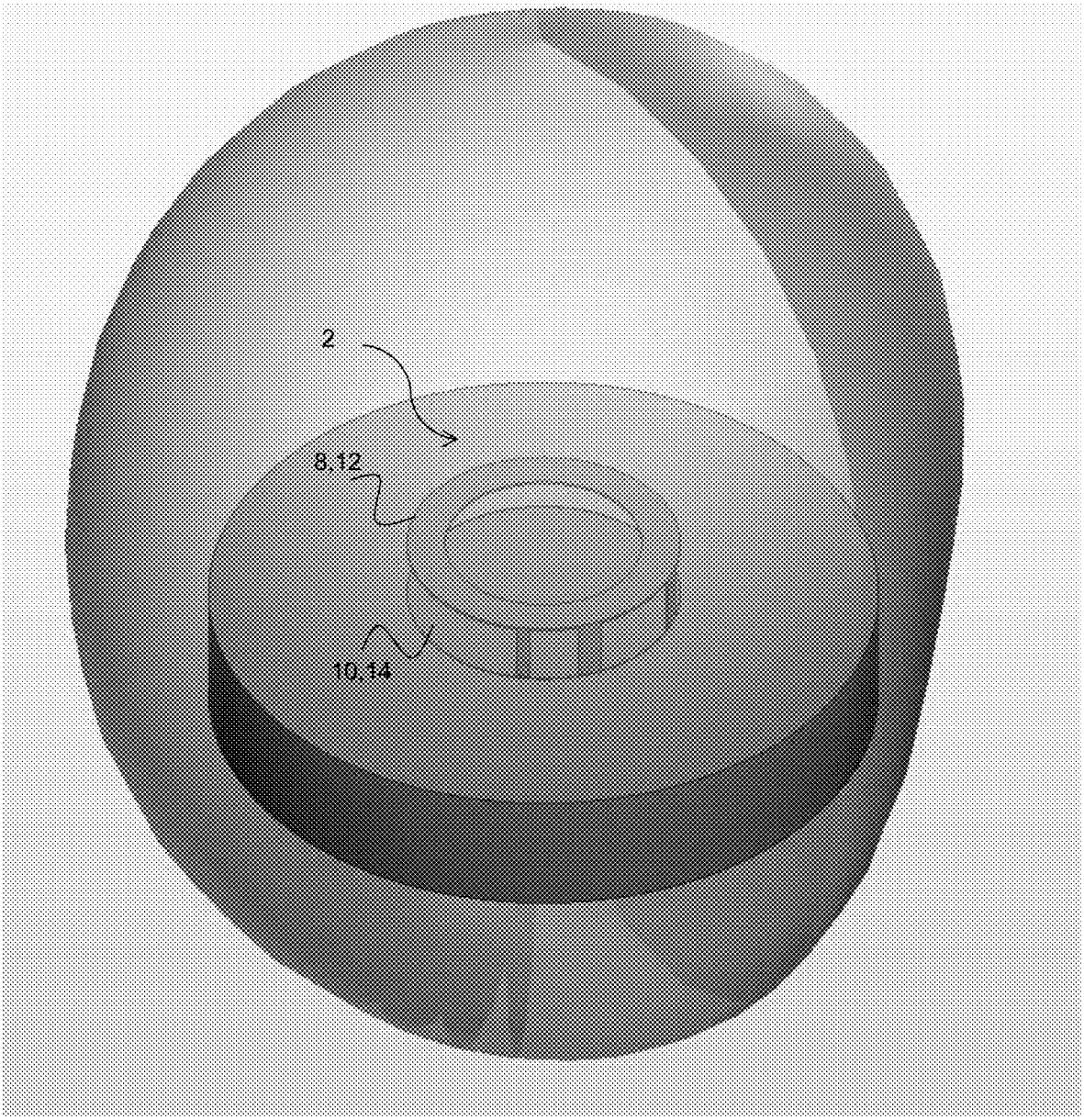
Figure 6B:
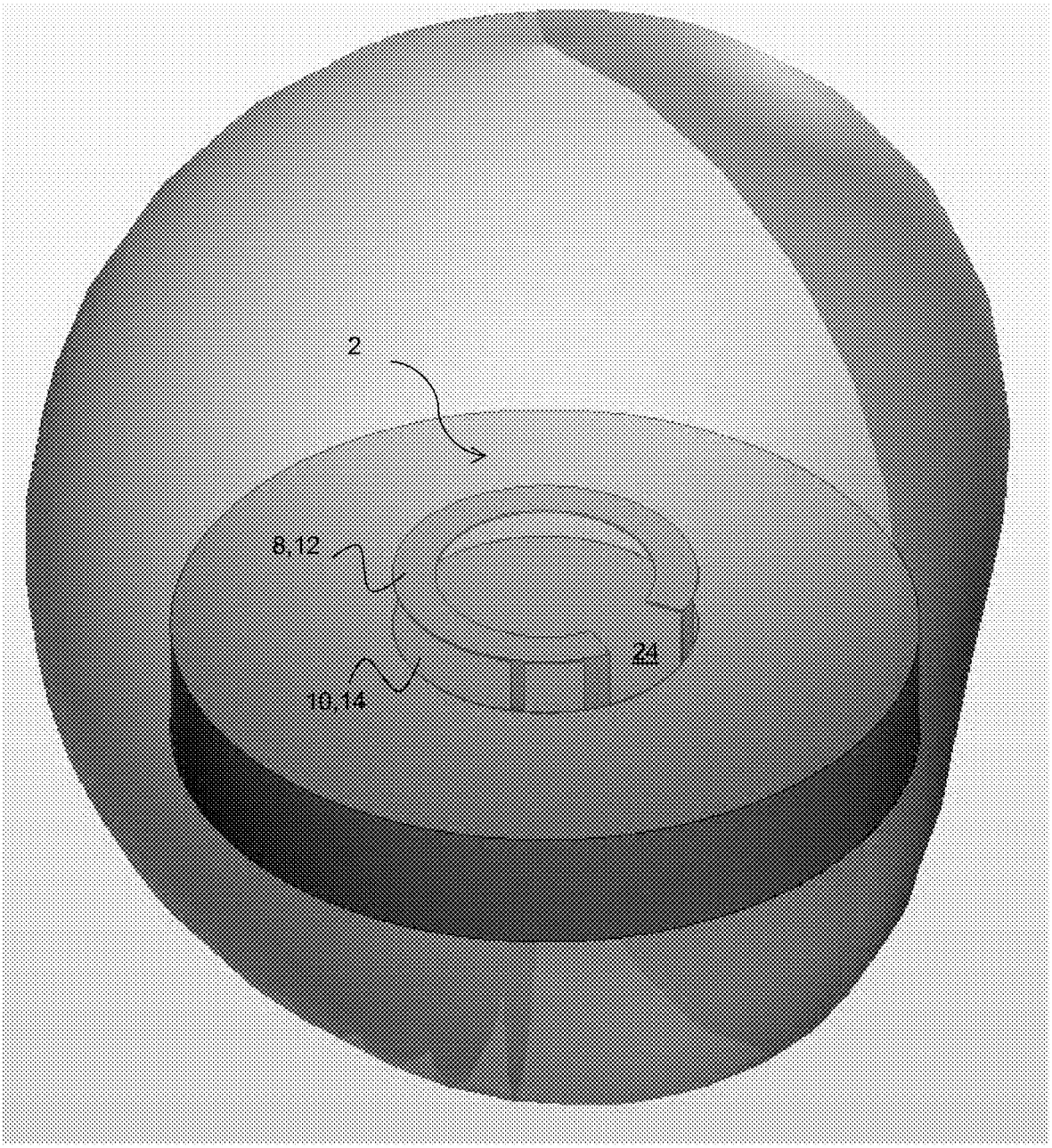
Figure 6C:
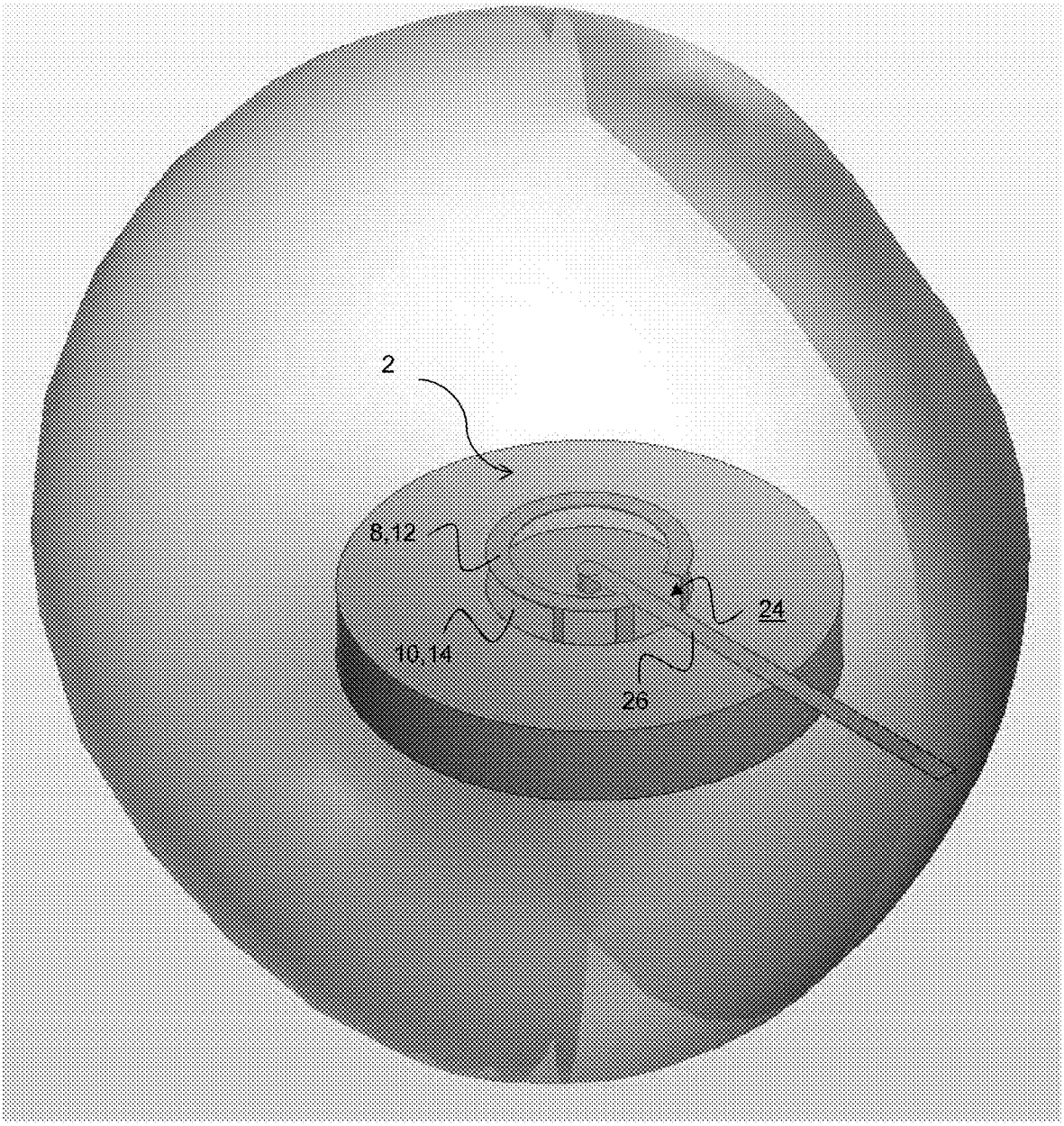

FIGS. 6A, 6B, 6C schematically illustrate computer simulated radiation diagrams or patterns, seen in an inclined view from above, for:

FIG. 6A shows a prior art antenna structure 2 having a closed circular loop radiator element 8.

FIG. 6B shows an antenna structure 2 having an opening 24 in the circular radiator element 8.

FIG. 6C shows an antenna structure 2 having an opening 24 in the circular radiator element 8 and where an object 26 is provided on the ground plate 10 and extending out through the opening 24.

As seen from the three figures, the three radiation diagrams or patterns are substantially similar, thus an opening 24 can be provided in the radiator element 8 without substantially disturbing the radiation properties of the antenna structure 2, see FIG. 6B, when compared to a prior art closed radiation element, see FIG. 6A.

Likewise can a headset component 26 be provided on the ground plate 10 and extending out through the opening 24 in the radiator element 8 without substantially disturbing the radiation properties of the antenna structure 2, see FIG. 6C, when compared to a prior art closed radiation element, see FIG. 6A.

Figure 7A:
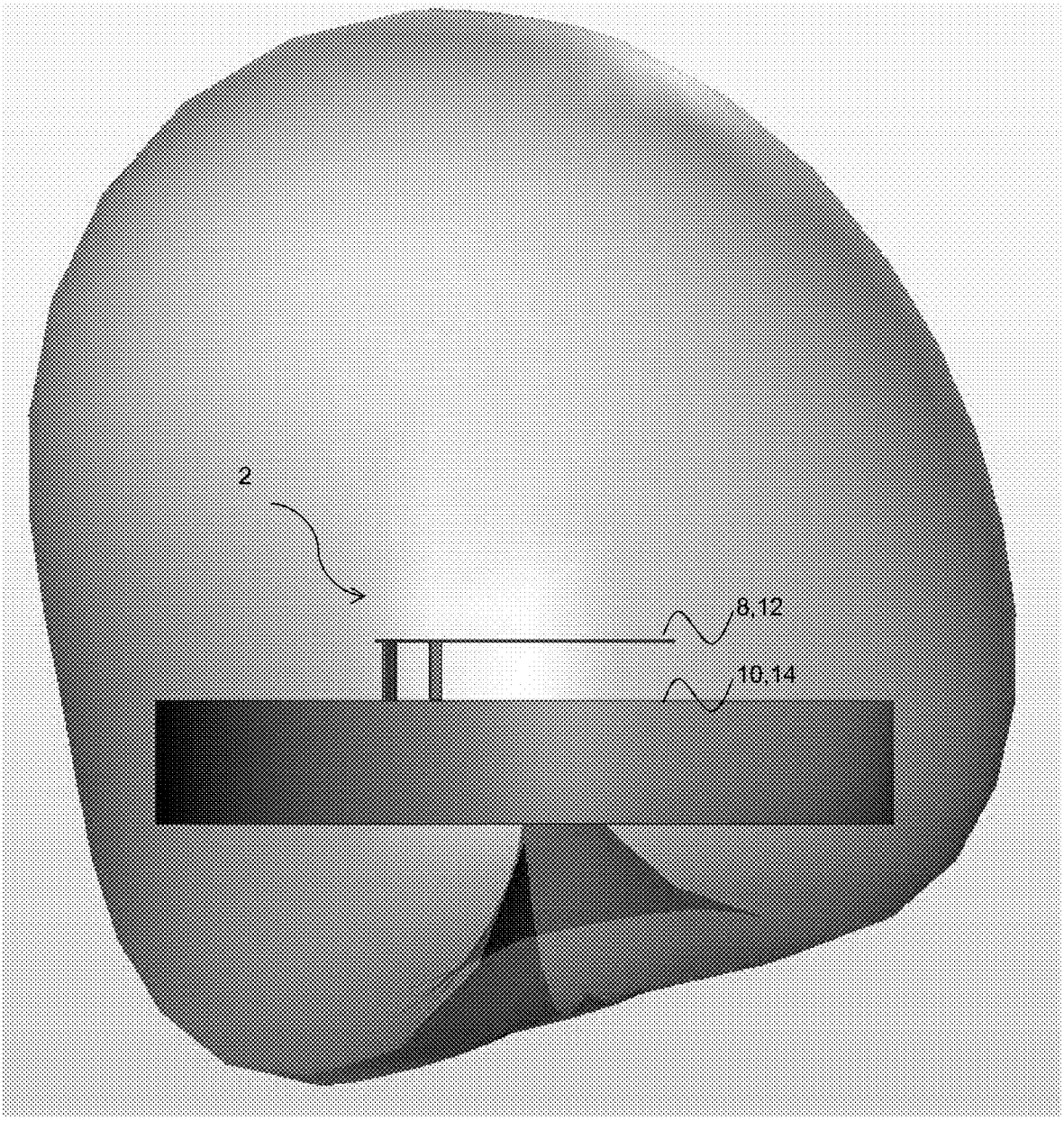
FIGS. 7A, 7B, 7C schematically illustrate computer simulated radiation diagrams or patterns, seen from the side, for the same antenna structures as shown in FIGS. 6A, 6B, 6C.
Figure 7B:
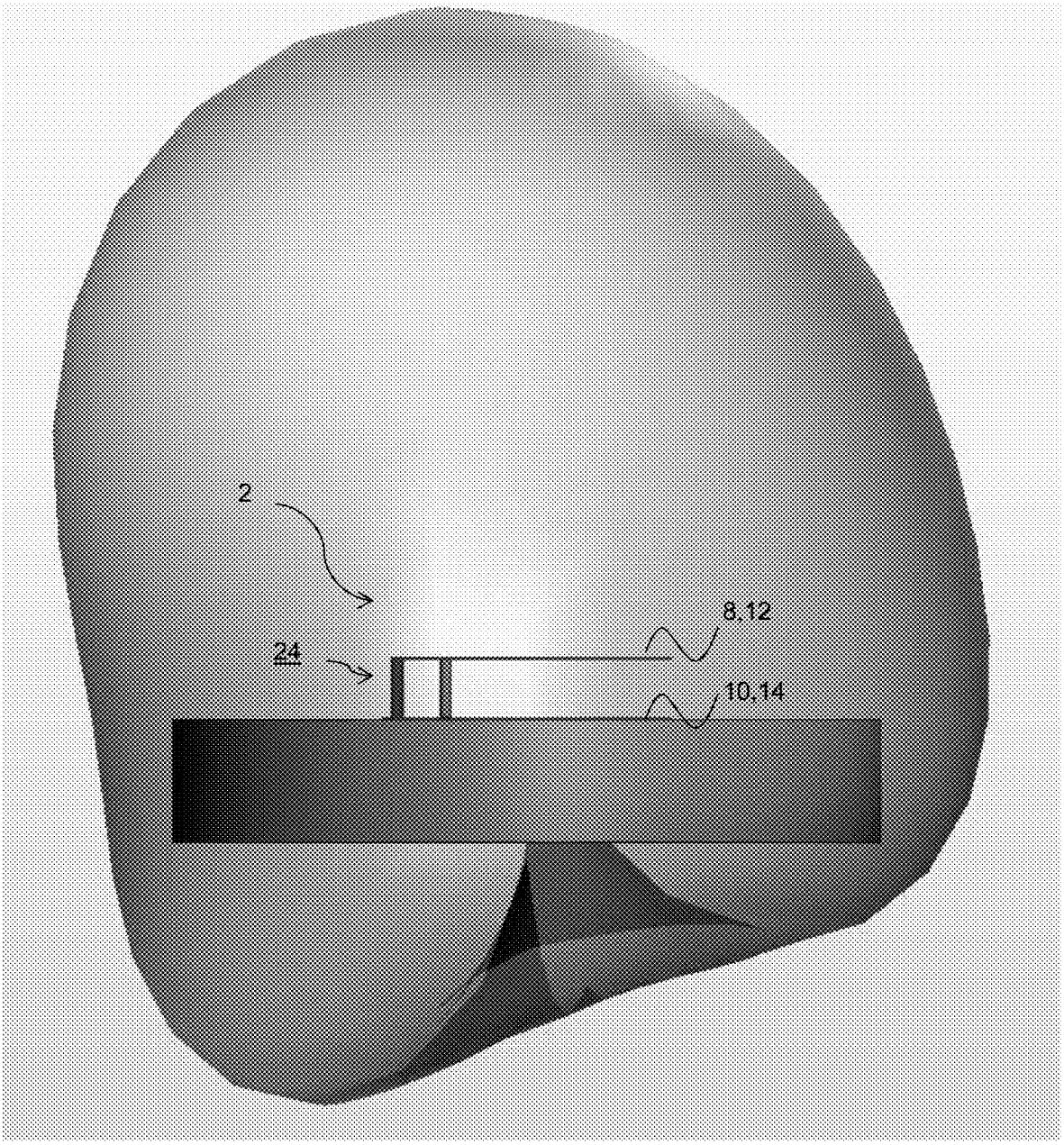
Figure 7C:
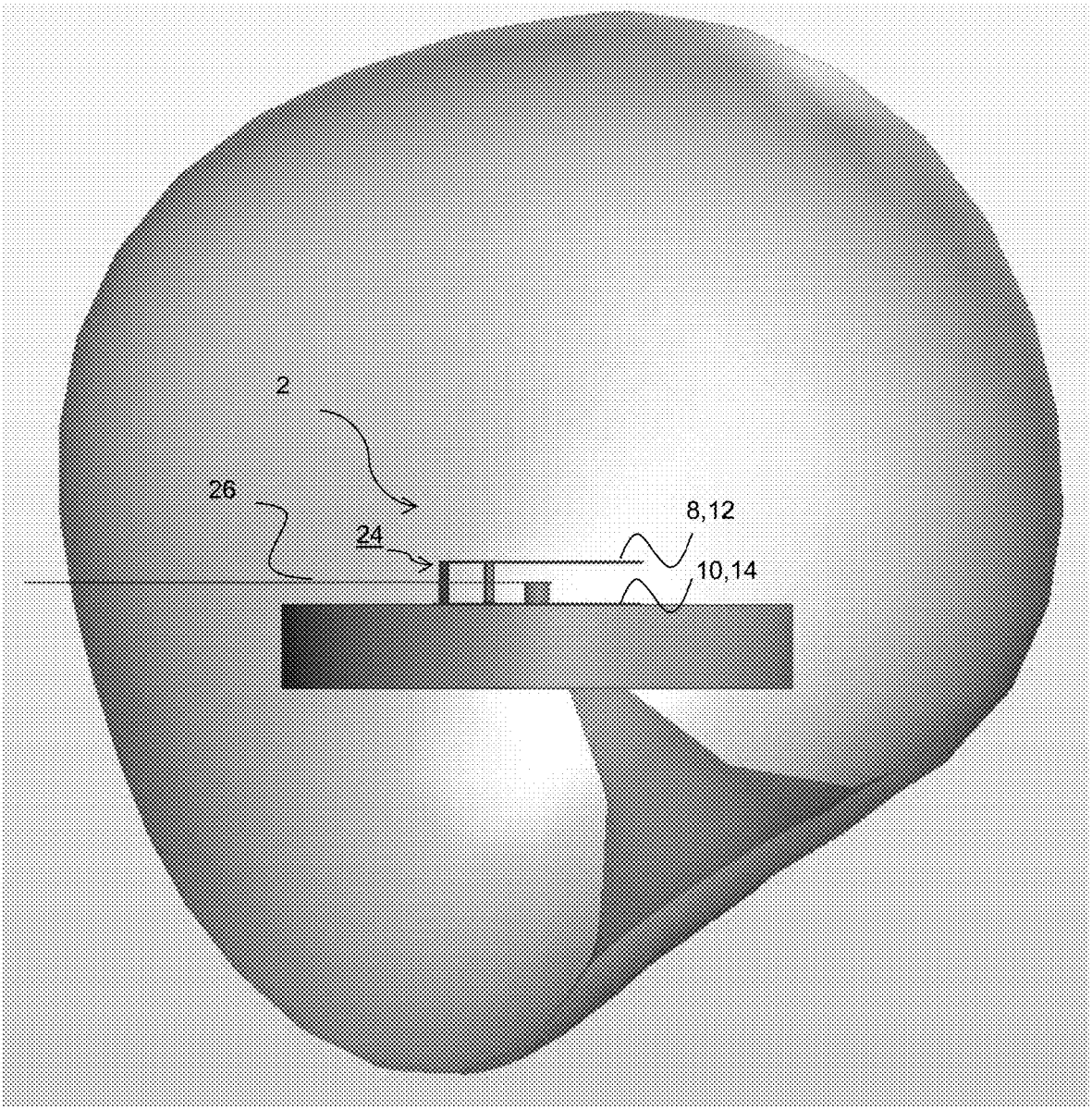

FIGS. 7A, 7B, 7C schematically illustrate computer simulated radiation diagrams or patterns, seen from the side, for the same antenna structures as shown in FIGS. 6A, 6B, 6C:

FIG. 7A shows a prior art antenna structure 2 having a closed circular loop radiator element 8.

FIG. 7B shows an antenna structure 2 having an opening 24 in the circular radiator element 8.

FIG. 7C shows an antenna structure 2 having an opening 24 in the circular radiator element 8 and where an object 26 is provided on the ground plate 10 and extending out through the opening 24.

As seen from the three figures, and also seen in FIGS. 6A, 6B and 6C, the three radiation diagrams or patterns are substantially similar, thus an opening 24 can be provided in the radiator element 8 without substantially disturbing the radiation properties of the antenna structure 2, see FIG. 7B, when compared to a prior art closed radiation element, see FIG. 7A.

Likewise can an object 26 be provided on the ground plate 10 and extending out through the opening 24 in the radiator element 8 without substantially disturbing the radiation properties of the antenna structure 2, see FIG. 7C, when compared to a prior art closed radiation element, see FIG. 7A.

The figures show that the object is connected to ground plate at the center of the ground plate, however it is understood that the object 26 may be arranged at any position within the space defined by the first plane 12 of the radiator element 8 and the second plane 14 of the ground plate 10, while still obtaining substantially the same radiation diagram.

Figure 8A:
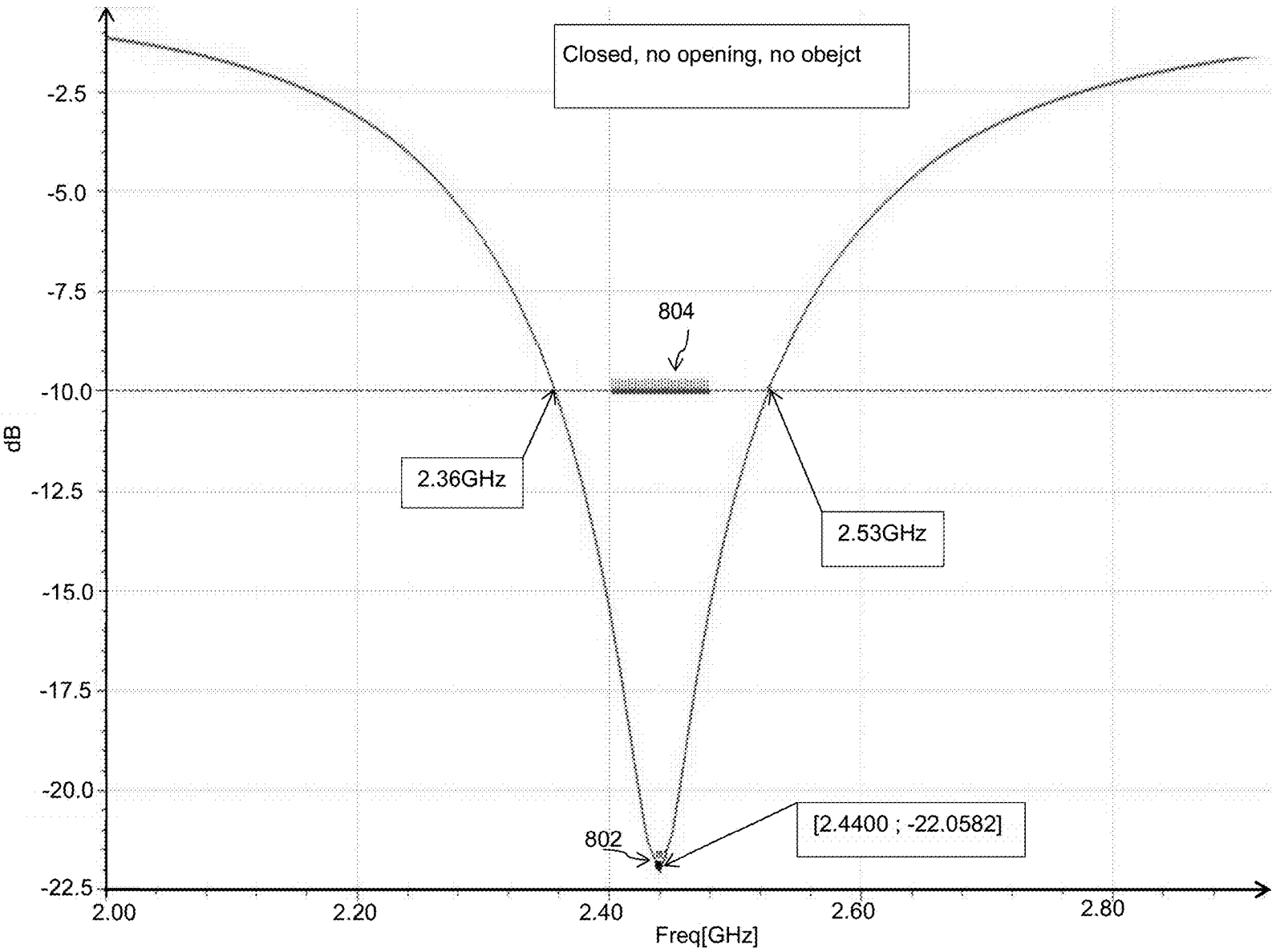
FIGS. 8A, 8B and 8C illustrate simulations of the antenna efficiency as a function of bandwidth for the three antenna structures shown in FIGS. 6A+7A, 6B+7B, 6C+7C, respectively.
Figure 8B:
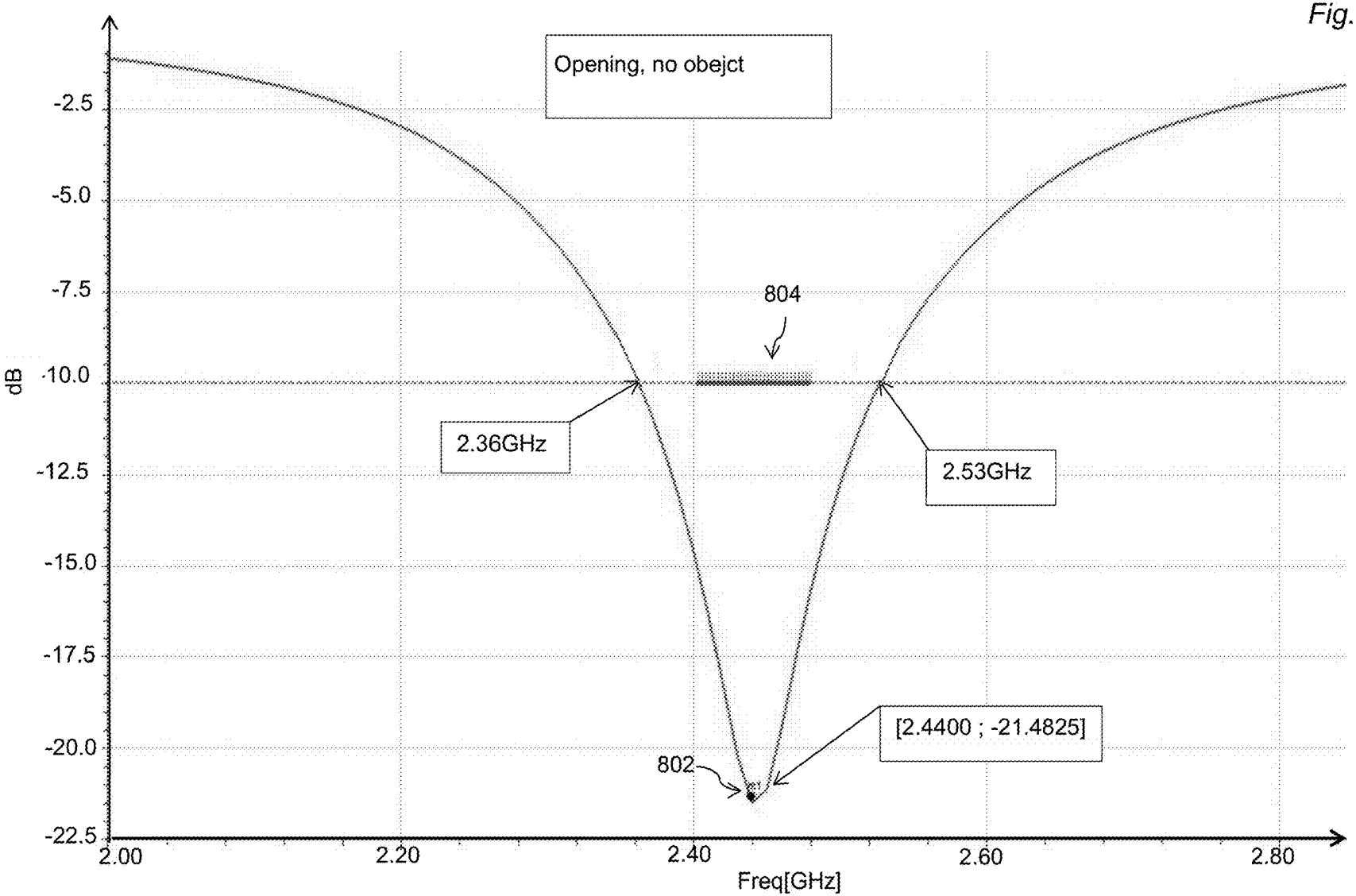
Figure 8C:
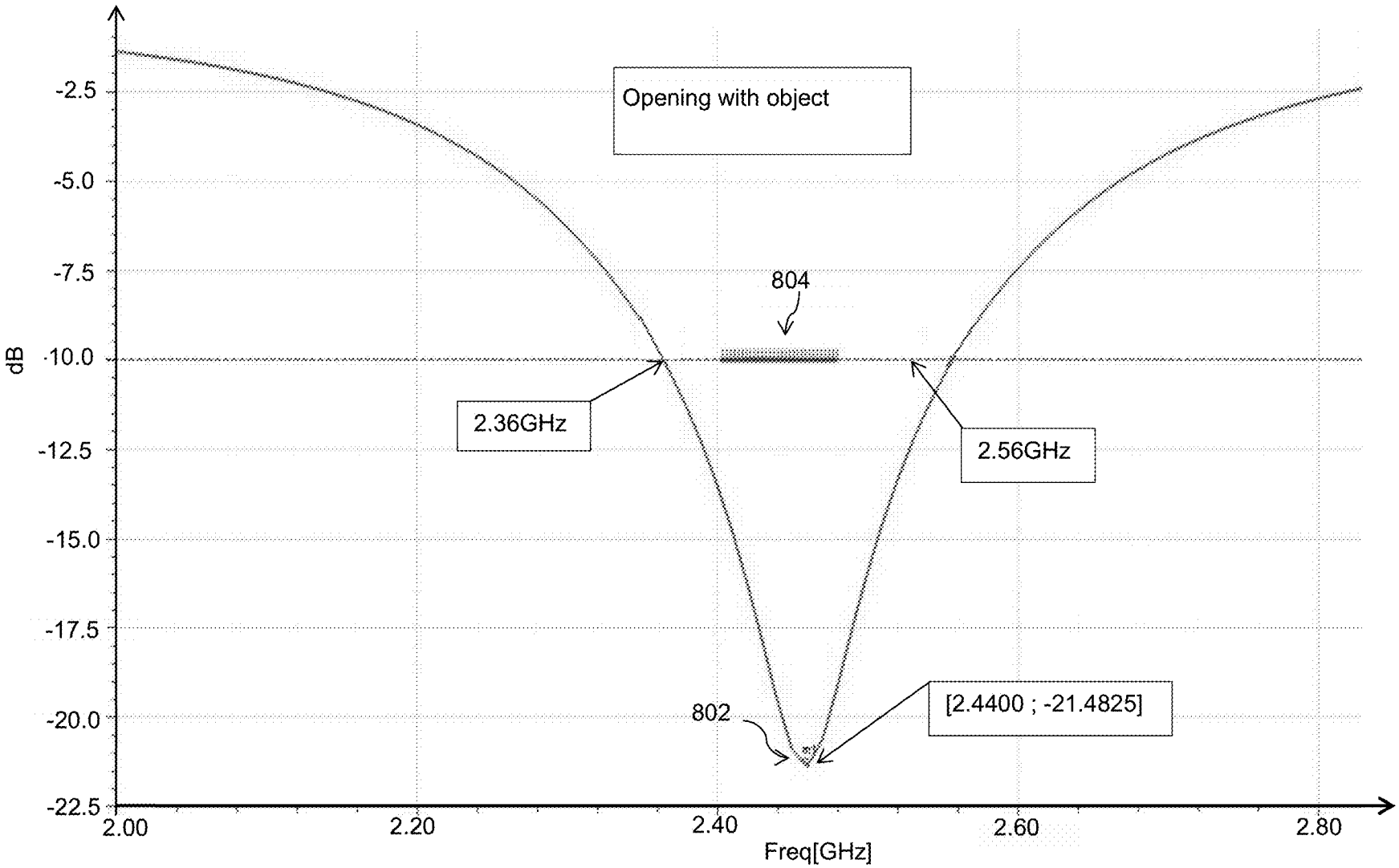

FIGS. 8A, 8B and 8C illustrate simulations of the antenna efficiency as a function of bandwidth for the three antenna structures shown in FIGS. 6A+7A, 6B+7B, 6C+7C, respectively. The efficiency of the antenna structure is shown on the y-axis, and measured in dB, as a function of the frequency shown on the x-axis and measured in GHz.

As seen from FIGS. 8A, 8B and 8C the center frequency 802 and the bandwidth 804 are substantially similar for the three antenna structures, thus an opening in the radiator element, as seen in FIGS. 6B+7B, can be provided without substantially disturbing the radiation properties in terms of center frequency and bandwidth of the antenna structure 2, when comparing the prior art closed radiator element of FIGS. 8A with 8B.

Likewise can an object be provided on the ground plate and extending out through the opening in the radiator element, as seen in FIGS. 6C+7C without substantially disturbing the radiation properties in terms of center frequency and bandwidth of the antenna structure 2, when comparing the prior art closed radiator element of FIG. 8A with FIG. 8C.

Figure 9A:
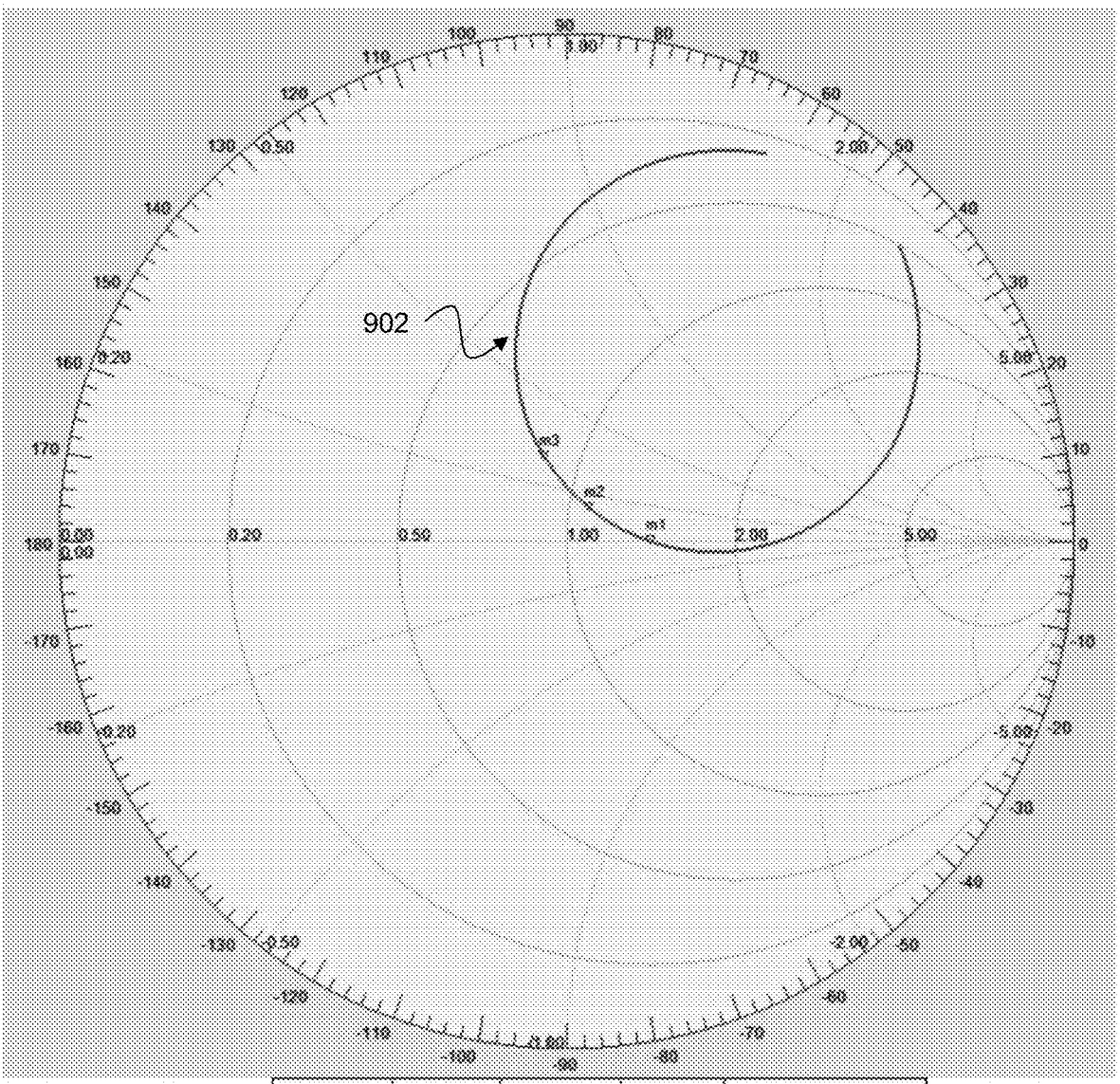
FIGS. 9A, 9B and 9C illustrate simulated Smith charts for the three antenna structures shown in FIGS. 6A+7A, 6B+7B, 6C+7C, respectively.
Figure 9B:
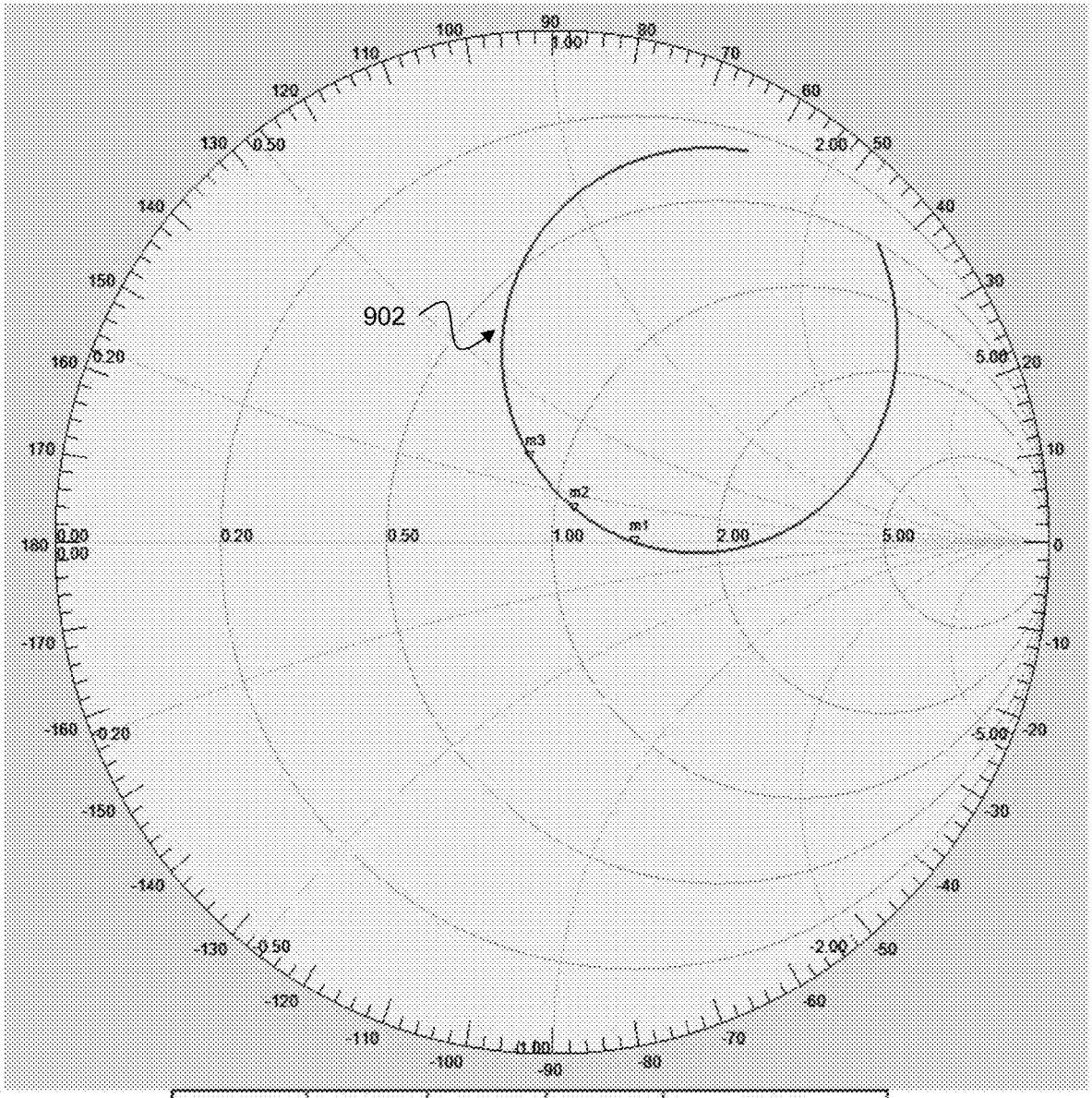
Figure 9C:
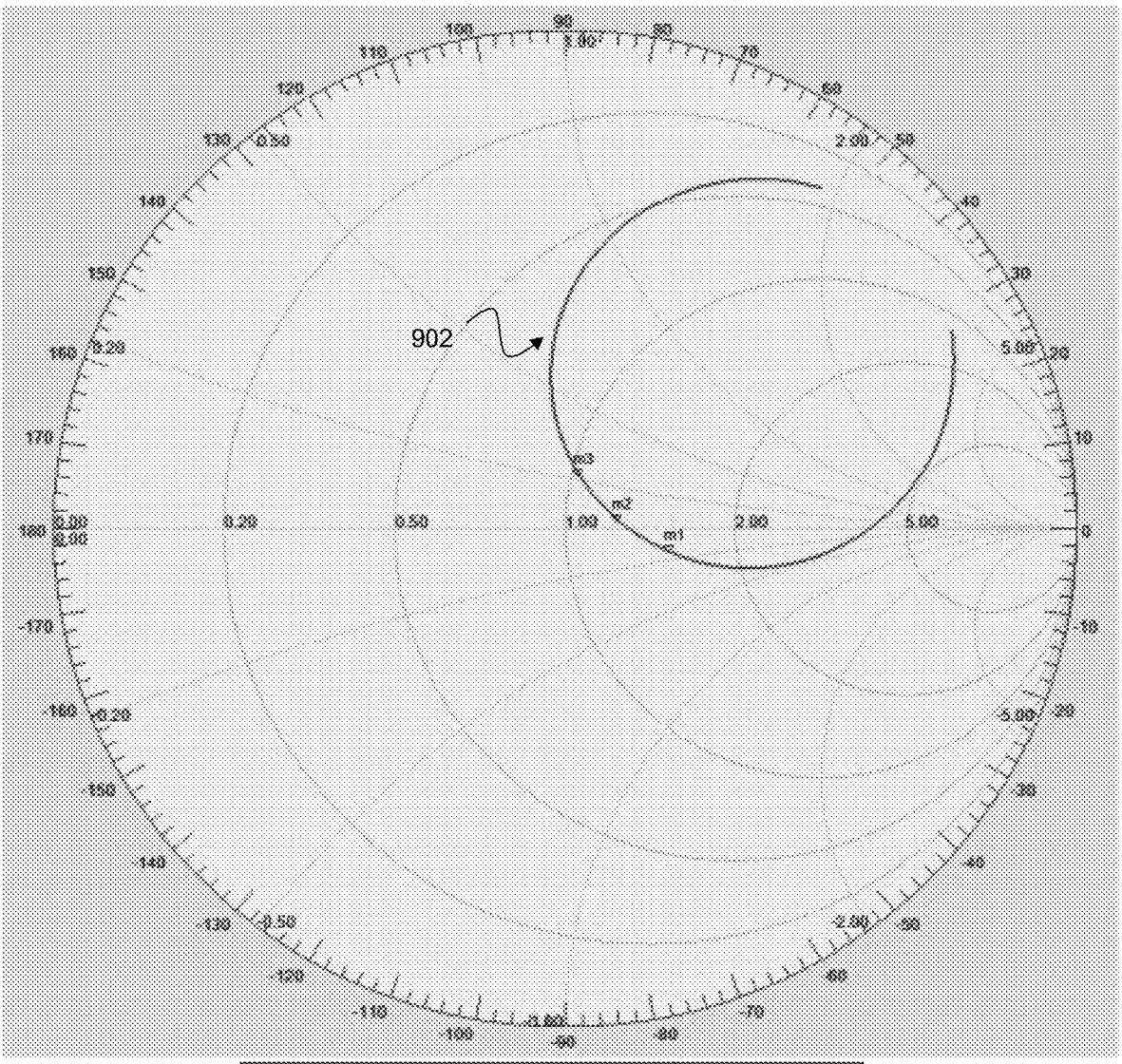

FIGS. 9A, 9B and 9C illustrate simulated Smith charts for the three antenna structures shown in FIGS. 6A+7A, 6B+7B, 6C+7C, respectively. It is seen that the transmission line 902 of the characteristic impedance is substantially similar for the three antenna structures.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

The following is an exemplary antenna structure. Reference numerals are provide only to assist reader in identifying exemplary elements.

There is disclosed an antenna structure (2) configured to be provided in a headset (4) to be worn on or at the head (6) of a user, the antenna structure (2) having any or all of the following elements:

a radiator element (8) in connection with a ground plate (10);

where the radiator element (8) is arranged in a first plane (12), and the ground plate (10) is arranged in a second plane (14);

where the first plane (12), in which the radiator element (8) is arranged, is configured to be arranged substantially parallel to the surface (16) of the head (6) of the user, when the user wears the headset (4) in its intended position on the head (6);

where the radiator element (8) and the ground plate (10) are connected by a first ground connector (18), a second ground connector (20) and a feed connector (22);

where the radiator element (8) has an electrical length of about a half-wavelength between the first ground connector (18) and the second ground connector (20);

wherein the radiator element (8) has an opening (24) between the first ground connector (18) and the second ground connector (20); and wherein the opening (24) between the first ground connector (18) and the second ground connector (20) provides that an object (26) is configured to be arranged between the first plane (12) and the second plane (14).

Also disclosed is an antenna structure (2) wherein the object (26) is configured to be arranged at least partly between the first ground connector (18) and the second ground connector (20).

Also disclosed is an antenna structure wherein the opening (24) between the first ground connector (18) and the second ground connector (20) provides that the object (26) is configured to extend through the opening (24).

Also disclosed is an antenna structure wherein the opening (24) is less than ⅓ (one third) of the length of the radiator element (8), such as less than ¼, ⅕, ⅙, ⅐, or ⅛, or ⅑, or 1/10, or 1/15, or 1/20 of the length of the radiator element (8).

Also disclosed is an antenna structure wherein the radiator element (8) has a two-dimensional geometric shape, such as circular or polygonal.

Also disclosed is an antenna structure wherein the first plane (12), in which the radiator element (8) is arranged, is substantially parallel to the second plane (14), in which the ground plate (10) is arranged, and wherein the second plane (14) is provided between the first plane (12) and the surface (16) of the head (6) of the user, when the user wears the headset (4) in its intended position on the head (6).

Also disclosed is an antenna structure wherein the radiator element has an inner perimeter/circumference and an outer perimeter/circumference, and wherein the distance between the inner perimeter/circumference and the outer perimeter/circumference defines the width of the radiator element along the length of the radiator element.

Also disclosed is an antenna structure wherein the width of the radiator element is constant along the length of the radiator element, or wherein the width of the radiator element varies along the length of the radiator element.

Also disclosed is an antenna structure wherein the ground plate has a two-dimensional geometric shape similar to the two-dimensional geometric shape of the radiator element, and wherein the ground plate has a perimeter/circumference.

Also disclosed is an antenna structure wherein the outer perimeter/circumference of the radiator element is larger than the perimeter/circumference of the ground plate.

Also disclosed is an antenna structure wherein a space in the first plane is present within the inner circumference of the radiator element.

Also disclosed is an antenna structure wherein the space in the first plane provides that the object is configured to extend through the space in the first plane.

Also disclosed is an antenna structure wherein the object configured to be arranged between the first plane and the second plane is a headset component.

Also disclosed is an antenna structure wherein the object configured to be arranged between the first plane and the second plane is a charging connector.

Also disclosed is an antenna structure wherein the object configured to be arranged between the first plane and the second plane is one or more electrical wires configured for connecting a microphone boom arm of a headset to the ground plate.

Also disclosed is an antenna structure wherein the ground plate comprises a printed circuit board, the printed circuit board comprising a processing unit.

Also disclosed is an antenna structure wherein the operating frequency band of the antenna structure is the DECT frequency band operating at 1880 to 1900 MHz.

Also disclosed is an antenna structure wherein the operating frequency band of the antenna structure is the Bluetooth frequency band operating at 2.4 to 2.485 GHz.

Also disclosed is an antenna structure wherein the radiator element is arranged at a height above the ground plate, wherein the height is in a range about 2 mm-10 mm, such as in a range about 3 mm-7 mm, such as in a range about 4 mm-5 mm.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 antenna structure
4 headset
6 head of user
8 radiator element
10 ground plate
12 first plane
14 second plane
16 surface of the head of the user
18 first ground connector
20 second ground connector
22 feed connector
24 opening
26 object
28 speaker housing
30 microphone boom
32 battery
34 speaker
802 center frequency
804 bandwidth
902 transmission line of characteristic impedance

The invention claimed is:

1. An antenna structure configured to be provided in a headset to be worn on or at the head of a user, the antenna structure comprising a radiator element in connection with a ground plate;

where the radiator element is arranged in a first plane, and the ground plate is arranged in a second plane;

where the radiator element and the ground plate are connected by a first ground connector, a second ground connector and a feed connector;

where the radiator element has an electrical length of about a half-wavelength between the first ground connector and the second ground connector;

wherein the radiator element has an opening between the first ground connector and the second ground connector; and wherein the opening between the first ground connector and the second ground connector is configured for providing that an object extends through the opening, where the object is configured to be arranged between the first plane and the second plane.

2. An antenna structure according to claim 1, wherein the object is configured to be arranged at least partly between the first ground connector and the second ground connector.

3. An antenna structure according to claim 1, wherein the opening is less than ⅓ (one third) of the length of the radiator element, such as less than ¼, ⅕, ⅙, ⅐, or ⅛, or ⅑, or 1/10, or 1/15, or 1/20 of the length of the radiator element.

4. An antenna structure according to claim 1, wherein the radiator element has a two-dimensional geometric shape, such as circular or polygonal.

5. An antenna structure according to claim 1, wherein the first plane, in which the radiator element is arranged, is substantially parallel to the second plane, in which the ground plate is arranged.

6. An antenna structure according to claim 1, wherein the radiator element has an inner perimeter/circumference and an outer perimeter/circumference, and wherein the distance between the inner perimeter/circumference and the outer perimeter/circumference defines the width of the radiator element along the length of the radiator element.

7. An antenna structure according to claim 1, wherein the width of the radiator element is constant along the length of the radiator element, or wherein the width of the radiator element varies along the length of the radiator element.

8. An antenna structure according to claim 1, wherein the ground plate has a two-dimensional geometric shape similar to the two-dimensional geometric shape of the radiator element, and wherein the ground plate has a perimeter/circumference.

9. An antenna structure according to claim 1, wherein the outer perimeter/circumference of the radiator element is larger than the perimeter/circumference of the ground plate.

10. An antenna structure according to claim 1, wherein a space in the first plane is present within the inner circumference of the radiator element.

11. An antenna element structure according to claim 1, wherein the space in the first plane provides that the object is configured to extend through the space in the first plane.

12. An antenna structure according to claim 1, wherein the object configured to be arranged between the first plane and the second plane is a headset component.

13. An antenna structure according to claim 1, wherein the object configured to be arranged between the first plane and the second plane is a charging connector.

14. An antenna structure according to claim 1, wherein the object configured to be arranged between the first plane and the second plane is one or more electrical wires configured for connecting a microphone boom arm of a headset to the ground plate.

15. An antenna structure according to claim 1, wherein the ground plate comprises a printed circuit board, the printed circuit board comprising a processing unit.

16. An antenna structure according to claim 1, wherein the operating frequency band of the antenna structure is the DECT frequency band operating at 1880 to 1900 MHz.

17. An antenna structure according to claim 1, wherein the operating frequency band of the antenna structure is the Bluetooth frequency band operating at 2.4 to 2.485 GHz.

18. An antenna structure according to claim 1, wherein the radiator element is arranged at a height above the ground plate, wherein the height is in a range about 2 mm-10 mm, such as in a range about 3 mm-7 mm, such as in a range about 4 mm-5 mm.

* * * * *